United States Patent [19]

Sando et al.

[11] 4,346,503

[45] Aug. 31, 1982

[54] PROCESS FOR DE-TWISTING AND CRAPING A CLOTH COMPOSED OF TWISTED YARNS

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 100,265

[22] Filed: Dec. 4, 1979

[30] Foreign Application Priority Data

Dec. 20, 1978 [JP] Japan ..... 53-157149

[51] Int. Cl.[3] ..... D06B 3/10

[52] U.S. Cl. ..... 28/155; 8/149.1; 8/152; 68/5 D; 68/62

[58] Field of Search ..... 28/155; 26/1, 18.5; 8/149.1, 149.3, 152; 68/5 E, 5 D, 62

[56] References Cited

U.S. PATENT DOCUMENTS

| | | | |
|---|---|---|---|
| 797,659 | 8/1905 | Baron | 26/1 |
| 3,172,275 | 3/1965 | Sando et al. | 68/5 E |
| 3,330,134 | 7/1967 | Carpenter | 68/178 X |
| 3,594,914 | 7/1971 | Kutsuki et al. | 26/18.5 UX |
| 3,812,599 | 5/1974 | Bruckner | 26/18.5 X |
| 3,965,511 | 6/1976 | Fleissner | 8/149.3 |
| 3,978,696 | 9/1976 | Ito et al. | 26/18.5 X |
| 4,087,993 | 5/1978 | Sando et al. | 68/177 X |

FOREIGN PATENT DOCUMENTS

| | | | |
|---|---|---|---|
| 1129445 | 5/1962 | Fed. Rep. of Germany | 68/5 D |
| 37-15439 | 9/1962 | Japan | 68/178 |
| 47-16777 | 9/1972 | Japan | 68/5 D |
| 50-16460 | 6/1975 | Japan | 68/5 D |

*Primary Examiner*—Robert Mackey

*Attorney, Agent, or Firm*—Toren, McGeady and Stanger

[57] ABSTRACT

A method including transporting a cloth composed of twisted yarns continuously through a plurality of wet-heat treating chambers, which have a stepwise temperature gradient from 70° C. to 100° C. and are provided with an appropriate impact device to apply beating and rubbing forces to the cloth, in the direction from the low temperature side to the high temperature side of the chambers to de-twist the yarn of the cloth so as to crape the cloth successively. A cloth composed of highly twisted yarns can be advantageously and effectively de-twisted and craped due to the effect of the swelling of the cloth as well as the beating and rubbing forces applied to the cloth in each of the wet-heat treating chambers.

1 Claim, 2 Drawing Figures

PROCESS FOR DE-TWISTING AND CRAPING A CLOTH COMPOSED OF TWISTED YARNS

BACKGROUND OF THE INVENTION

The present invention relates to a process for de-twisting and craping a cloth woven with highly twisted yarns, the object being to de-twist the twisted yarns of the cloth so as to form fine crapes all over the cloth.

Twisted yarns for constructing a cloth usually have 600 to 2500 twists per meter and the cloth obtained can be craped by de-twisting the yarns constructing the cloth.

The craping of cloth of this kind has conventionally been done as follows: A cloth with a limited length is wound around a frame, and the hems of the wound cloth are sewn together; a plurality of the unit bodies thus obtained are introduced in a drum rotating in a batch to give an impact to the unit bodies by the rotation of the drum while elevating the temperature of the wet heat in the batch successively in a heating pattern, for instance, as shown in FIG. 1; and cooling the interior of the batch slowly down to about 40° C. when the temperature of the batch reaches about 100° C., and then the cloth is taken out from the drum.

However, such a conventional cloth craping process has various defects such as:

a. A process is needed to wind the cloth of a definite length around a frame, deteriorating the workability.

b. Since the cloth is sewn together after winding it around the frame, the craping of the cloth is done insufficiently.

c. Since the treatment is done discontinuously, the productivity is low.

d. The batch must be opened every time in replacing the cloth in the drum to set free the wet heat in the batch completely, deteriorating the heat efficiency.

e. The wet heat condition in the batch can hardly be maintained constant in each of the operations, so that uniform craping of a series of cloths can by no means be expected.

Accordingly, the present invention is to offer a new continuous process for the craping of a cloth to eliminate various defects in craping as above mentioned.

DETAILED EXPLANATION OF THE INVENTION

The basic technical thought of the present invention is to transport a cloth composed of twisted yarns continuously through a plurality of wet-heat treating chambers to subject the cloth to de-twisting.

In the present invention, the cloth is transported through a plurality of wet-heat treating chambers, which have a stepwise temperature gradient from 70° C. to 100° C. and are provided with an appropriate impact device to give a beating and rubbing effect to the cloth, in the direction from the low temperature side to the high temperature side of the chambers to de-twist the yarn of the cloth so as to crape the cloth successively.

Due to the effect of the swelling of the cloth as well as the beating and rubbing forces applied to the cloth in each of the wet-heat treating chambers, a cloth composed of highly twisted yarns can be effectively de-twisted and craped. Particularly, since the cloth to be treated is heated under wet-heat stepwise from a low temperature of about 70° C. to a high temperature of about 100° C. while receiving swelling as well as beating and rubbing forces successively, the craping can be done uniformly all over the cloth, thus giving a high quality product.

Furthermore, since the process is continuous, the process is quite simple, lowering the labor, the energy consumption and the processing cost. Thus, the present inventive process is very advantageous for mass production.

PREFERRED EMBODIMENT OF THE INVENTION

Figure 1:
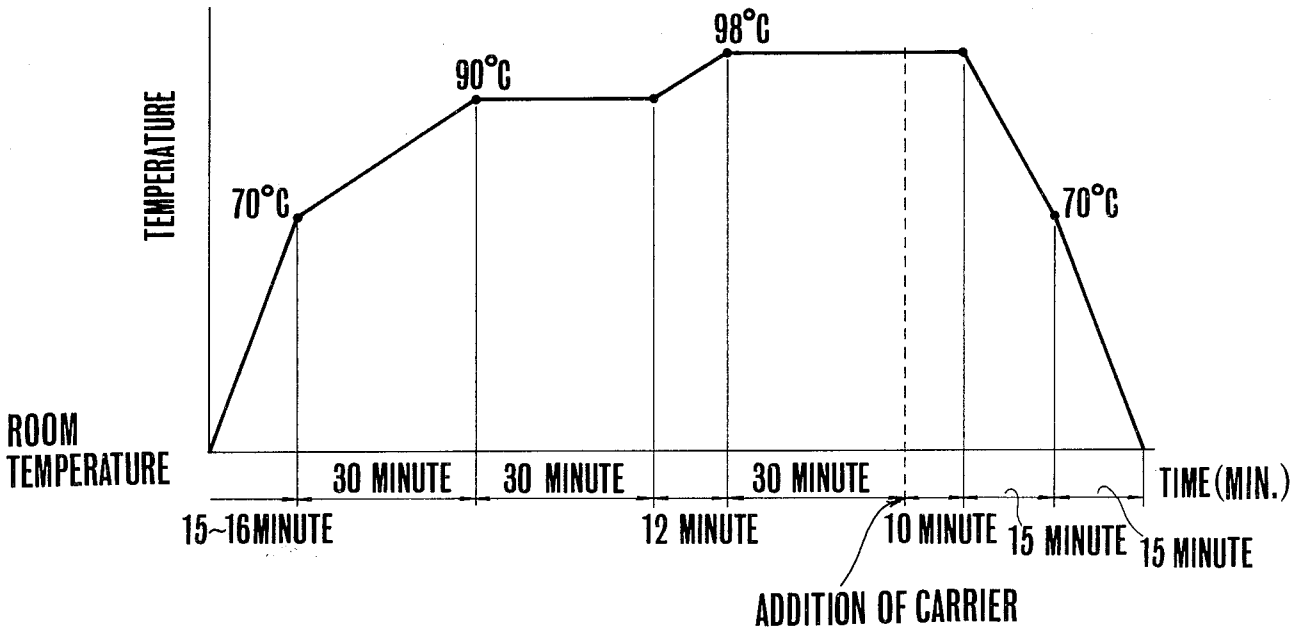
FIG. 1 PRIOR ART
FIG. 1 is a diagrammatic showing of a conventional heating pattern.
Figure 2:
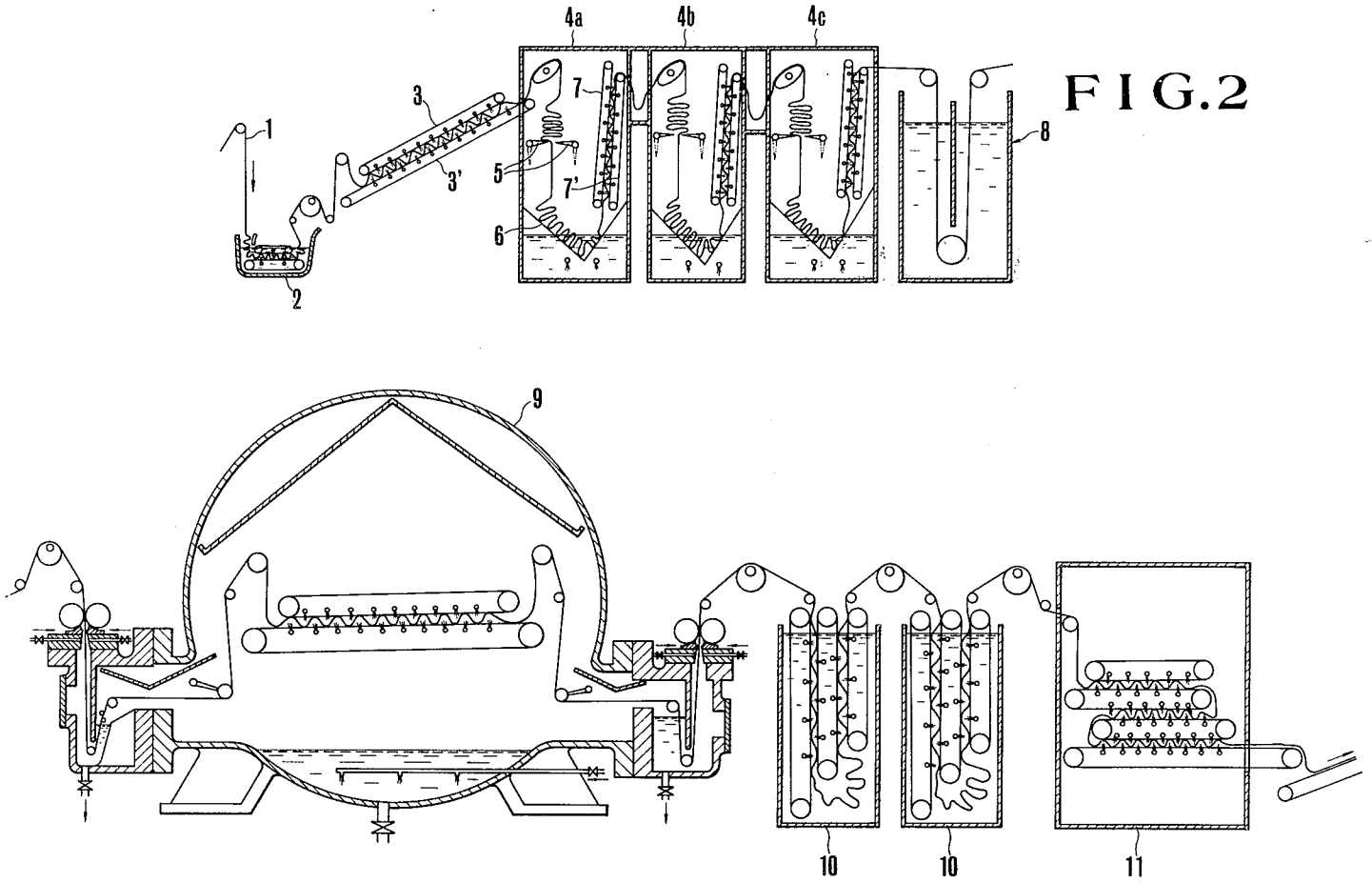
FIG. 2 is a schematic illustration partly in section of apparatus for carrying out the present invention.

FIG. 2 is the sectional side view of an example of the apparatus to perform the craping of a cloth in the present invention. In the figure, 1 is a cloth to be processed, 2 is a liquid tank, 3 and 3' are net conveyers, **4*a*, 4*b* and 4*c* are wet-heat treating chambers, 5 is a receiving table for the cloth, 6 is a bottom plate, 7 and 7' are net conveyers, 8 is a cooling device, 9 is a high pressure steamer, 10 are washing tanks and 11** is a drier.

A cloth 1 to be craped, which is composed, for instance, of highly twisted yarns of 100% polyester filaments, is firstly immersed in hot water in the liquid tank 2 to impregnate the cloth with hot water for swelling. Then cloth 1 is transferred by means of a pair of net conveyers 3 and 3', while the cloth is heated preliminarily up to about 60° C. by spraying heated air thereto.

The thus preliminarily heated cloth is supplied into the first wet-heat treating chamber **4*a* maintained at a wet heat of from 60° to 70° C. In the first wet-heat treating chamber 4*a*, the cloth partially swollen with the wet heat in the chamber is piled for a while on the cloth receiving table 5. When the cloth piled on the cloth receiving table 5 reaches a definite amount, the cloth receiving table opens spontaneously due to the weight, and the cloth falls on the V-shaped bottom plate 6 while receiving a beating force due to the falling of the cloth. The cloth which fell on the bottom plate 6 is impregnated further with hot water in the bottom of the chamber and transferred upwardly in succession by means of a pair of net conveyers 7 and 7'** while receiving beating and rubbing forces due to the steam jetted thereto.

The cloth, swollen, beaten and rubbed to de-twist the yarns thereof to some extent in the wet-heat treating chamber **4*a* at a temperature about 60° to 70° C. is transferred into the second wet-heat treating chamber 4*b* maintained at a wet heat of about 85° C. The role of the second wet-heat treating chamber 4*b* is the same as in the first wet-heat treating chamber 4*a***, and the de-twisting of the yarns of the cloth proceeds further to crape the cloth in the chamber.

The cloth is then transferred into the third wet-heat treating chamber **4*c* maintained at a wet heat of about 95° C. Since the wet-heat treating chamber 4*c*** is at a sufficiently high temperature wet heat, the de-twisting of the yarns proceeds sufficiently to complete the craping of the cloth.

The cloth, sufficiently craped due to the de-twisting of the yarns thereof, is cooled down to about 40° C. by means of a suitable cooling device, air cooling or water cooling, 8, and the process is completed.

The thus processed cloth may further be treated, as shown in the figure, by supplying the cloth to the high pressure steamer 9 and by passing through the washing tanks 10 and the drier 11 to finish the cloth.

What we claim is:

1. A process for de-twisting and craping a cloth composed of twisted yarns, comprising transporting a cloth continuously and serially through at least three vertically extending wet-heat treating chambers so that the cloth passes, in turn, through each of the at least three chambers, providing a liquid level in the lower part of each chamber with a bottom plate located in each chamber partly above and partly below the liquid level therein, maintaining a temperature gradient from 70° C. to 100° C. between the chambers with the temperature increasing stepwise by a gradient of at least 10° C. from chamber to chamber in the direction of passage of the cloth through the chambers, introducing the cloth, in turn, into each of the treating chambers and piling the cloth within each treating chamber onto a cloth-receiving table spaced upwardly from the liquid level and above the bottom plate, opening the cloth receiving tables intermittently and spontaneously when the cloth piled thereon reaches a definite amount with the cloth falling due to its weight onto the bottom plate of the wet-heat treating chamber above the liquid level for imparting beating and rubbing forces to the cloth, moving the cloth over the bottom plate below the liquid level and impregnating the cloth with hot water below the liquid level in in each treating chamber, moving the cloth over the bottom plate to above the liquid level and, above the liquid level, passing the cloth upwardly in each treating chamber through a narrow passage and jetting steam into the passage from opposite sides thereof for beating and rubbing the cloth, removing the cloth from the last one of the treating chambers and cooling the cloth to about 40° C. and thereby de-twisting the yarn of the cloth for craping the cloth successively due to the effect of the swelling of the cloth as well as the beating and rubbing forces applied to the cloth in each of the wet-heat treating chambers.

* * * * *